US008042967B2

(12) United States Patent
Hikmet et al.

(10) Patent No.: US 8,042,967 B2
(45) Date of Patent: Oct. 25, 2011

(54) LAMP MODULE AND LIGHTING DEVICE COMPRISING SUCH A LAMP MODULE

(75) Inventors: Rifat Ata Mustafa Hikmet, Eindhoven (NL); Ties Van Bommel, Eindhoven (NL); Chi Keung Lau, Maastricht (NL); Yiu Wing Ha, Hong Kong (CN)

(73) Assignee: Koninklijke Philips Electronics N.V., Eindhoven (NL)

( * ) Notice: Subject to any disclaimer, the term of this patent is extended or adjusted under 35 U.S.C. 154(b) by 549 days.

(21) Appl. No.: 12/160,914

(22) PCT Filed: Jan. 10, 2007

(86) PCT No.: PCT/IB2007/050074

§ 371 (c)(1), (2), (4) Date: Jul. 15, 2008

(87) PCT Pub. No.: WO2007/080543

PCT Pub. Date: Jul. 19, 2007

(65) Prior Publication Data

US 2010/0148688 A1 Jun. 17, 2010

(30) Foreign Application Priority Data

Jan. 16, 2006 (EP) ..... 06100359

(51) Int. Cl.
*F21L 4/00* (2006.01)
*F21L 4/04* (2006.01)

(52) U.S. Cl. ..... 362/208; 362/200

(58) Field of Classification Search ..... 362/196–208
See application file for complete search history.

(56) References Cited

U.S. PATENT DOCUMENTS

| | | | | |
|---|---|---|---|---|
| 5,161,879 | A | 11/1992 | McDermott | |
| 5,424,927 | A * | 6/1995 | Schaller et al. | 362/157 |
| 6,062,702 | A | 5/2000 | Krietzman | |
| 6,357,893 | B1 | 3/2002 | Belliveau | |
| 6,474,837 | B1 | 11/2002 | Belliveau | |
| 2005/0007772 | A1 * | 1/2005 | Yen | 362/206 |

FOREIGN PATENT DOCUMENTS

| | | | |
|---|---|---|---|
| DE | 19937852 | C2 | 3/2001 |
| DE | 10233719 | A1 | 2/2004 |
| EP | 1255132 | A1 | 11/2002 |
| EP | 1422467 | A2 | 5/2004 |
| EP | 1610059 | A2 | 12/2005 |
| WO | W02004097772 | A1 | 11/2004 |
| WO | W02005121641 | A1 | 12/2005 |

* cited by examiner

*Primary Examiner* — Diane Lee
*Assistant Examiner* — William Carter

(57) ABSTRACT

The present invention relates to a lamp module (10) comprising at least one light emitting diode (LED) chip (12) for emitting light, means (13, 15, 16, 17) for extracting and shaping the light emitted from the chip(s), and a base (21) for allowing the lamp module to be fitted and connected to a lighting device. The lamp module is characterized by at least one electrically switchable cell (22) adapted to receive light emitted from the LED chip(s), which cell in a first state transmits incoming light without substantially altering the direction of the light and in a second state alters the direction of the light when the light passes the cell(s). This allows for electrically controlled adjustable beam shaping. The present invention also relates to a lighting device (30) comprising such a lamp module.

20 Claims, 3 Drawing Sheets

LAMP MODULE AND LIGHTING DEVICE COMPRISING SUCH A LAMP MODULE

Figure 1A:
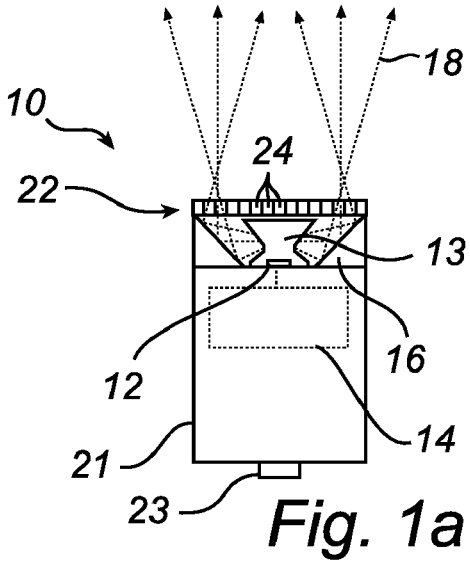

The present invention relates to a light emitting diode (LED) lamp module, and a lighting device comprising such a lamp module.

Light emitting diode (LED) lamp modules with integrated electronics has recently become available on the market. Such a LED lamp module can be used in various lighting devices, for example bicycle lamps, torch/flash lamps, head lamps, etc.

In such a lighting device, as well as in other lighting devices having traditional light sources or lamp modules, it is desirable to adjust the shape and the direction of the light originating from the lighting device's light source. This can be achieved mechanically, for example by moving the position of a reflector with respect to the light source, or by arranging multiple light sources on a flexible substrate, such as disclosed in the document U.S. Pat. No. 6,357,893. In U.S. Pat. No. 6,357,893, mechanical means are provided to flex the substrate in a concave of convex manner, whereby the collimation and the beam size can be altered. Adjustment of the beam size is advantageous as it gives the possibility for widening the beam at a desired moment.

However, mechanical solutions can be rather slow and unreliable (the substrate in U.S. Pat. No. 6,357,893 can get stuck), and they sometimes require a user to execute a considerable manual operation, such as moving or turning an element of the lighting device (for example the whole reflector), to alter the beam shape.

It is an object of the present invention to overcome these problems, and to provide a lamp module which allows beam shaping and beam direction adjusting functionality, either on its own or when mounted in a lighting device.

This and other objects that will be evident from the following description are achieved by means of a lamp module, and a lighting device comprising such a lamp module, according to the appended claims.

According to an aspect of the invention, there is provided a lamp module comprising at least one LED chip for emitting light, means for extracting and shaping light emitted from the chip(s), and a base for allowing the lamp module to be fitted and connected to a lighting device, the lamp module being characterized by at least one electrically switchable cell adapted to receive light emitted from the LED chip(s), which cell in a first state transmits incoming light without substantially altering the direction of the light and in a second state alters the direction of the light when the light passes the cell(s).

Thus, the LED chip, extraction optics, base and cell forms an integrated unit intended to be fitted in a lighting device. By placing the cell in front of the LED chip(s) it becomes possible to alter the light distribution from the LED chip(s) simply by electrically controlling the state of the cell, which in turn make it possible to provide electronically controlled adjustable beam shaping. When the cell is integrated with the lamp module, the cell is general positioned proximate to the LED chip.

The means for extracting and shaping the light emitted from the LED chip(s) can be placed on top and/or around the LED chip(s), and it generally serves to direct light from the LED chip(s) forward. For example, it can comprise optics placed on top of the chip(s) and adapted to induce collimated side emission (i.e. a side emitting LED), in which case the means additionally comprises a reflector for directing light from the side emitting LED towards the cell. Alternatively, the means for extracting and shaping the light emitted from the LED chip(s) can comprise optics shaped to direct light from the LED chip(s) in a certain direction, such as a dome allowing an isotropic emission LED. Such a dome can optionally be combined with total internal reflection (TIR) optics or refractive or reflecting elements or a combination thereof for collimating and directing light from the isotropic emission LED towards the cell.

In one embodiment, the at least one cell is integrated into the means for extracting and shaping light emitted from the chip(s). For example, the cell can be integrated into the TIR optics surrounding the dome optics mentioned above. Integrating the cell into the means for extracting and shaping light emitted from the chip(s) is especially advantageous in a case where a cell which alters the direction of incoming light to large angles is used. When such a cell alters the direction of incoming light to a large angle, that is light is directed towards the side instead of in a forward direction, the result can be a dimming effect rather than beam shaping, i.e. a too wide beam is achieved. However, by integrating the cell into the extraction/shaping means, said means then can help to direct the light heading towards the side forward, as it does with the light emitted from the LED chip(s), whereby dimming is avoided and a less wide beam is achieved. Here, the lamp module allows beam shaping functionality on its own.

Alternatively, the cell can be mounted on top of the means for extracting and shaping the light emitted from the LED chip(s) (that is on top of the side emitting LED or the isotropic emission LED and the optional TIR optics). In such a case, the above mentioned dimming can be avoided by mounting the lamp module in a reflector of a lighting device, or by using a cell which does not alter the direction of incoming light to such large angles.

The direction of incoming light can for example be altered by the cell by means of one of scattering, refraction, reflection and diffraction. Additionally, the lamp module can comprise plural cells with different effects, which allows for greater flexibility and more possibilities to alter the light distribution from the LED chip in desired ways. For example, a cell which scatters the light from the LED chip(s) can be positioned on top of another cell which diffracts incoming light.

The lamp module can further comprise a LED driver coupled to the LED chip. Depending on the lamp module power source, the LED driver can comprise a AC-DC converter or DC-DC converter. The driver can supply current to the LED chip using for example frequency modulation, pulse width modulation or bit angle modulation.

Moreover, the lamp module can comprise a DC-AC converter for converting direct current from an external power source, such as a battery, to alternating current for supplying the cell. The cell usually requires alternating current, and the DC-AC converter can be used in case the lamp module is to be mounted in a lighting device running on direct current, such as a flashlight powered by a regular battery.

The lamp module can further comprise a processor configured to separately control the LED chip(s) and the state of the cell based on a common input signal. More specific, the processor is adapted to translate for example the duration/sequence/number of pulses of the signal (which preferably comes from a user operated switch on a lighting device in which the lamp module is mounted) to separately control the state of the cell and the LED chip accordingly. For example, a single short pulse can cause the processor to activate the LED chip only, while a single longer pulse can instruct the processor to activate both the LED chip and the cell. The processor, together with the integrated LED driver and the DC-AC converter, allows for a lamp module with only two contacts (to the switch and power source of the lighting device) which easily can be retrofitted to an existing lighting device, such as a regular flashlight. That is, all optical and electronic components are integrated in a compact lamp module. Further, both the LED (on/off) and the cell (beam shaping) can be operated with a single switch.

Alternatively, the lamp module can comprise means for converting a variable input voltage into a constant direct current supplying the LED chip(s) and a variable alternating current supplying the cell, wherein the alternating current supplying the cell varies in accordance with the input voltage. Thereby the beam shaping can be controlled by adjusting the input voltage to the lamp module. This also allows retrofit applications. The above mentioned DC-AC converter can here be used to convert the variable input voltage into the variable alternating current supplying the cell.

According to another aspect of the invention there is provided a lighting device comprising a lamp module according to the above description. The lighting device can be a non-mains connected device and/or a handheld device. For example the lighting device can be a torch light or flashlight, bicycle lamp, head lamp, rifle lamp, diving light, miners lamp, emergency light, spot light, etc.

The lighting device can comprise a DC-AC converter for converting direct current from an internal power source, such as a battery, to alternating current for supplying the cell. In this case, the DC-AC converter provided in the lamp module mentioned above can be omitted.

Further, in a case where the comprises a processor according to the above description, the lighting device preferably comprises a single switch for providing an input signal to the processor. Alternatively, if there is no such processor in the lamp module, the lighting device can instead comprise a first switch for controlling the state of the cell, and a second switch for controlling the LED chip.

Additionally, the lighting device preferably comprises a beam shaper, in which case the lamp module is positioned in the beam shaper. The beam shaper can for example comprise total internal reflection (TIR) optics or refractive or reflecting elements (such as a reflector) or a combination thereof. The reflector (or similar means) provides better control over the adjustable beam shaping.

These and other aspects of the present invention will now be described in more detail, with reference to the appended drawings showing currently preferred embodiments of the invention.

Figure 1B:
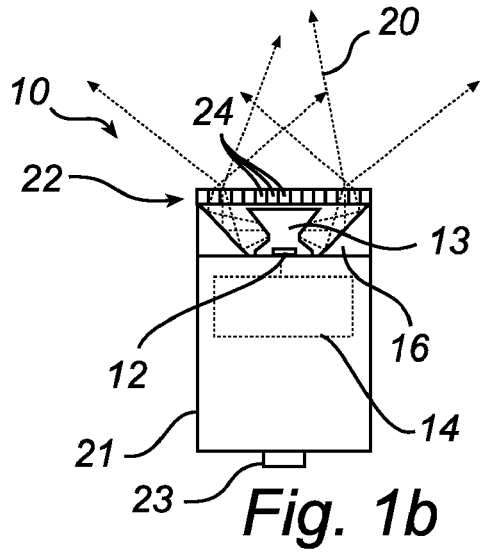
Figure 5A:
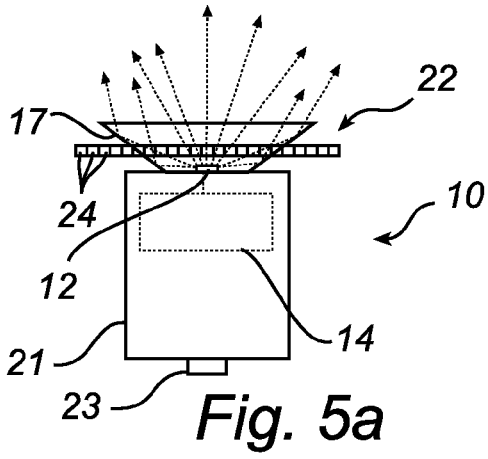
Figure 5B:
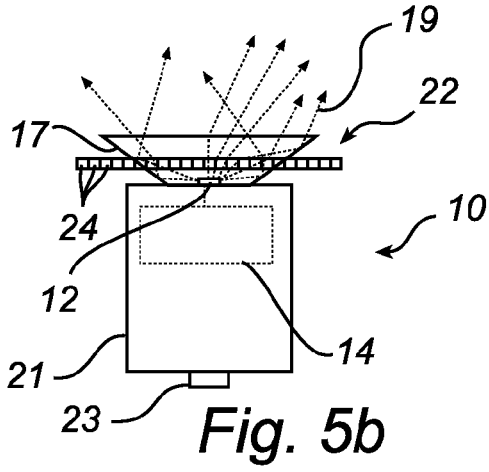
Figure 6A:
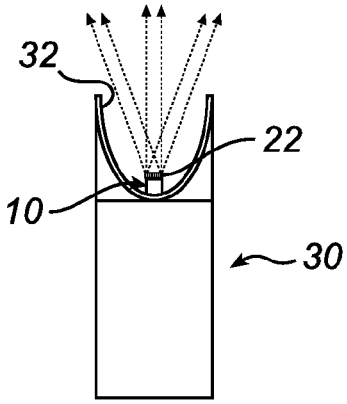
Figure 6B:
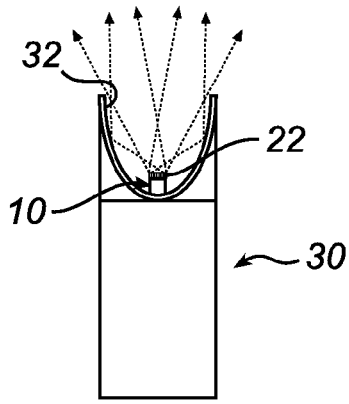
Figure 7:
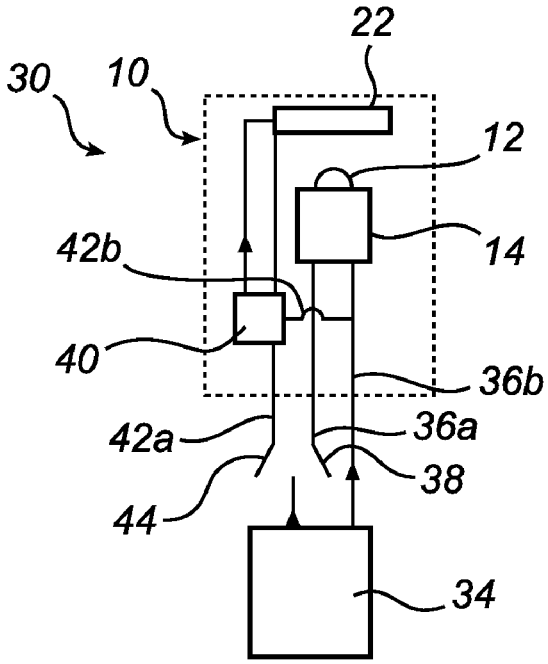
Figure 8:
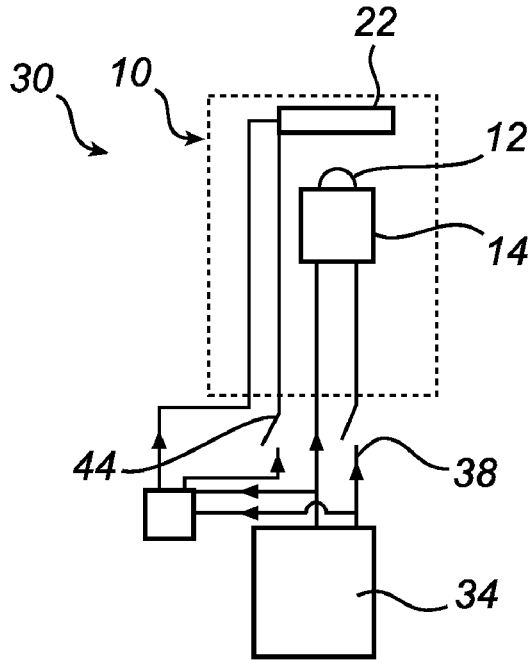
Figure 9:
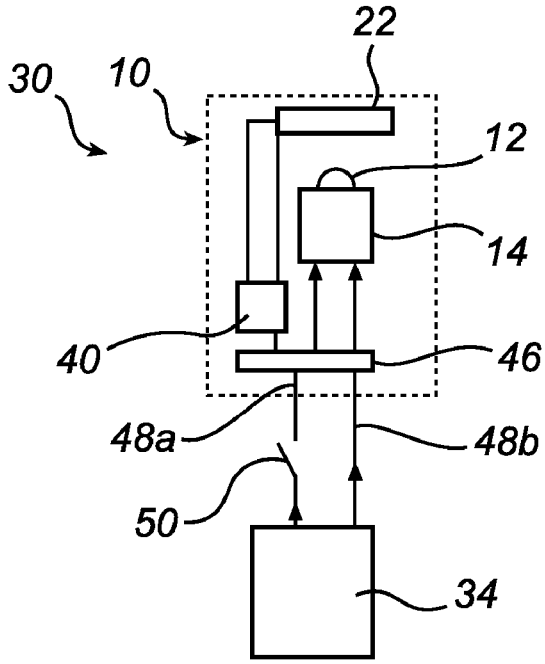

FIGS. 1*a*-1*b* are cross-sectional side views illustrating a lamp module according to an embodiment of the invention with the cell in the first and second state, respectively, FIGS. 2*a*-5*b* illustrate variants of the lamp module in FIGS. 1*a*-1*b*, FIGS. 6*a*-6*b* illustrate a lighting device according to an embodiment of the invention with the cell of the lamp module in the first and second state, respectively, FIG. 7 illustrates in more detail a lighting device and lamp module according to the invention, FIG. 8 illustrates a variant of the lighting device and lamp module in FIG. 7, and FIG. 9 illustrates another variant of the lighting and lamp module device in FIG. 7.

FIGS. 1*a*-1*b* are cross-sectional side views illustrating a lamp module 10 according to an embodiment of the invention. The lamp module 10 comprises a LED chip 12 mounted to a base 21, and optics 13 placed on top of the LED chip 12 for inducing collimated side emission (i.e. a side emitting LED). The LED chip 12 is coupled to a LED driver 14. The LED chip 12 and optics 13 are surrounded by a reflector 16 for reflecting the light emitted from the LED chip 12 forward, as indicated by ray-traces 18, 20. The base 21 is adapted to fit into a lamp socket of a lighting device (not shown), and it comprises contacts 23 for electrical connection between the lamp module 10 and the lighting device.

In front of the LED chip 12 and optics 13, there is provided a electrically switchable cell 22. The cell 22 has a first state wherein it transmits incoming light originating from the LED chip 12 without substantially altering the direction of the light, as indicated by ray-traces 18 in FIG. 1*a*, while in a second state, it alters the direction of incoming light, as indicated by ray-traces 20 in FIG. 1*b*, when the light passes the cell 22. Thus, during operation, when the cell 22 is in the first state the light originating from the LED chip 12 is led through the cell unaltered, while in the second state the path of the light is altered.

The cell 22 can for example be a liquid crystal cell comprising a single pixel, or an array of pixels or light modulating elements 24 (as in FIGS. 1*a*-1*b*). The cell can have active matrix-, multiplexed- or direct electrical addressing, and the alteration of direction or path of the incoming light can be achieved using electrically controllable liquid crystal effects, such as scattering, refraction, reflection or diffraction. Preferably, the cell 22 is so designed that essentially all light is forwardly scattered (or refracted or reflected or diffracted), that is, not scattered back towards the LED chips 12. Various liquid crystal effects/devices (cells) suitable for this invention will be apparent to those skilled in the art. For example, they may include electrically controllable scattering (PDLC, gel, etc.), LC graded refractive index optics (lens arrays etc), cholestric reflectors, surface topology covered LC optics (LC cells containing structures with a surface relief such as gratings, micro lens array, etc.), etc.

It should be noted that some cells (for example PDLCs) may alter the direction of some incoming light even in the "transparent state", namely the direction of light incoming towards the cell at large angles. Thus, only a portion of the light is transmitted through the cell with unaltered direction. Such a cell does of course not impose any major problem in case the major part of the light falls onto the cell at essentially right angles. However, if some light is incoming towards the cell at large angles, for example in case the light source (such as an isotropic emission LED) is placed very close to the cell, this light will be altered in direction whether the cell is "on" or "off". Thus the beam shaping effect of turning the cell on/off is diminished. Therefore, in case light is incoming towards the cell at large angles, for example if the LED chip is positioned very close to the cell, it is advantageous to use a cell which in its transparent state transmits essentially all light, regardless of angle of incidence, without altering the direction of the light, in order to achieve a distinguishable beam shaping effect when the state of the cell is switched. Such a cell can for example a gel based cell.

In one embodiment, all pixels or elements 24 of the cell 22 are switched when the state of the cell is changed. However, by switching only some of elements 24, various intermediate states can be achieved, which in turn allows for various degrees of beam shaping. This can be achieved by means of segmented or pixilated cell electrodes (not shown). In the same way the magnitude of the voltage applied to the cell can affect the degree of beam shaping. Also, different voltages can be supplied to different segments of the cell in order to achieve various effects.

Even though only one cell 22 is shown in FIGS. 1*a*-1*b*, multiple cells can be used in a single lamp module 10. For example a cell which scatters the light from the LED chip can be positioned on top of another cell which diffracts incoming light. In another example a cell which alters the direction of incoming light having a first polarization is positioned on top of a cell which alters the direction of incoming light having a second polarization. In yet another example a cell which mainly forms a rectangular beam is combined with a cell which forms a triangular beam shape from a circular beam.

Figure 2A:
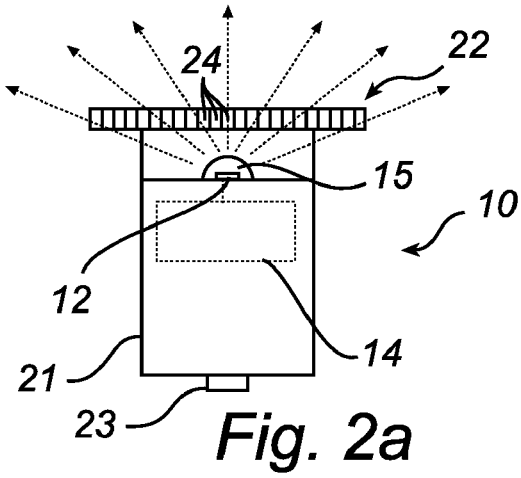
Figure 2B:
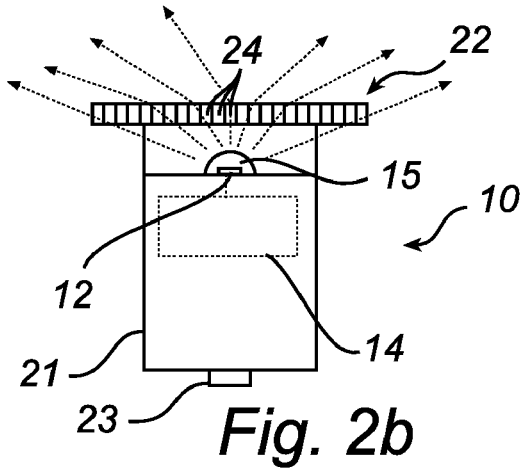

FIGS. 2*a*-2*b* illustrate a variant of the lamp module in FIGS. 1*a*-1*b*, where the side emitting optics 13 has been replaced by a dome 15 resulting in an isotropic emission type LED, and the reflector 16 is omitted. Thus, in the lamp module 10 in FIGS. 2*a*-2*b*, light emitted from the LED chip 12 is directed partly towards the cell 22. Otherwise the lamp module in FIGS. 2*a*-2*b* functions in the same way as the lamp module described in relation to FIGS. 1*a*-1*b* above.

Figure 3A:
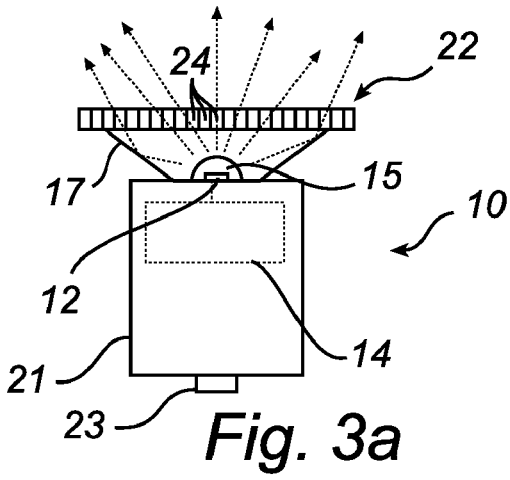
Figure 3B:
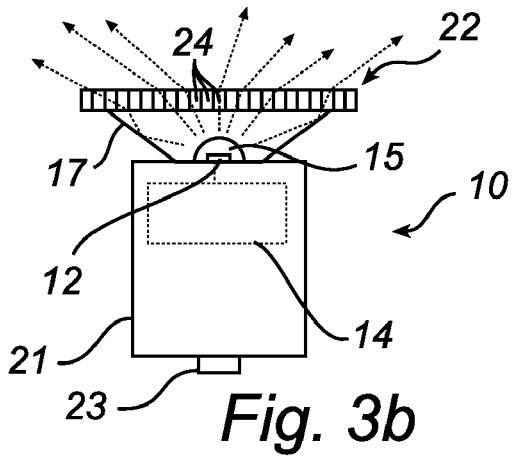

FIGS. 3*a*-3*b* illustrate another variant of the lamp module in FIGS. 1*a*-1*b*, where the side emitting optics 13 has been replaced by a dome 15 resulting in an isotropic emission type LED and the reflector 16 has been replaced by total internal reflection optics 17. Thus, in the lamp module 10 in FIGS. 3*a*-3*b*, light emitted from the LED chip 12 is directed by the TIP-optics 17 towards the cell 22. Otherwise the lamp module in FIGS. 3*a*-3*b* functions in the same way as the lamp module described in relation to FIGS. 1*a*-1*b* above.

Figure 4A:
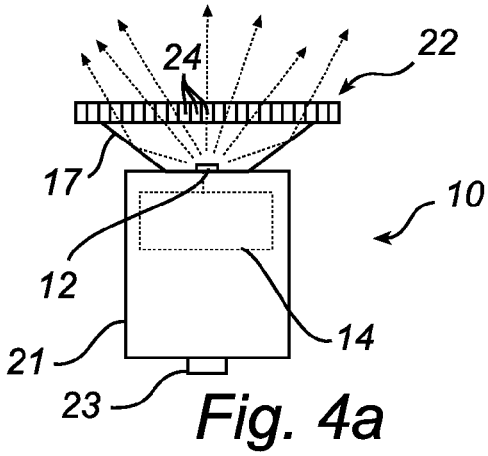
Figure 4B:
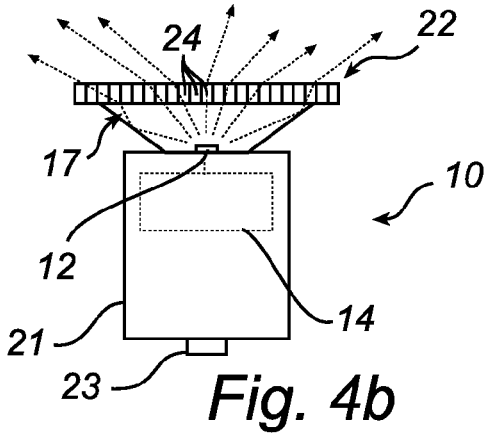

FIGS. 4*a*-4*b* illustrate yet another variant of the lamp module in FIGS. 1*a*-1*b*, where the side emitting optics 13 has been replaced by total internal reflection optics 17 resulting in a mainly forward emission type LED. The cell 22 is positioned on top of the TIR-optics 17. Thus, in the lamp module 10 in FIGS. 3*a*-3*b*, light emitted from the LED chip 12 is directed by the TIP-optics 17 towards the cell 22. Otherwise the lamp module in FIGS. 4*a*-4*b* functions in the same way as the lamp module described in relation to FIGS. 1*a*-1*b* above.

FIGS. 5*a*-5*b* illustrate yet another variant of the lamp module in FIGS. 1*a*-1*b*, where the side emitting optics 13 has been replaced by total internal reflection optics 17 resulting in a mainly forward emission type LED. Further, compared to the variant of the lamp module disclosed in FIGS. 4*a*-4*b*, the cell 22 is integrated in the TIR-optics 17. In this way, light directed to the sides by the cell 22 can be directed forward by the TIR-optics 17, see ray-trace 19, in order to avoid that the beam is spread too much. Otherwise the lamp module in FIGS. 4*a*-4*b* functions in the same way as the lamp module described in relation to FIGS. 1*a*-1*b* above.

Any of the lamp modules 10 disclosed above can advantageously be incorporated in a lighting device, an example of which is schematically disclosed in FIGS. 6*a*-6*b*. The lighting device 30 in FIGS. 6*a*-6*b* has a reflector 32, and the lamp module 10 is positioned in the reflector 32. In FIG. 6*a*, the cell 22 of the lamp module 10 is in the transmission state, whereby the light emitted from the lamp module 10 form a rather narrow beam of rays. On the other hand, in FIG. 6*b*, the cell 22 is in the scattering (or refracting or reflecting or diffraction) state, whereby light is altered in direction when exiting the lamp module 10. Some of the rays may be reflected by the reflector 32, and overall a wider beam of rays is created. Thus, by switching the cell 22 a different beam shape can be provided. The beam can here be shaped by a combination of the lamp module 10 and the reflector 32. The lighting device 30 can for example be a torch lamp, head lamp, rifle lamp, diving light, miners lamp, emergency light, spot light, or bicycle lamp.

It should be noted that in case a lamp module with inherent "extra" beam shaping means is used, such as the lamp module disclosed in FIGS. 5*a*-5*b* where the portion of the TIR-optics 17 "above" the cell 22 can direct altered light forward, or in case a cell 22 which does not alter the direction of incoming light to such large angles is used, the reflector 32 can be omitted.

In relation to the FIGS. 7-9, variants of a lighting device and lamp module according to the invention, such as the lighting device 30 and lamp module 10 illustrated in the previous figures, are discussed in more detail. In FIG. 7, the lighting device 30 comprises a lamp module 10 of any type described above, as well as a battery 34 for powering the lamp module 10. As above, the lamp module comprises a LED chips 12, LED driver 14 and an electronically switchable cell 22 (and optionally, depending on the type of LED, a reflector, optics, etc.). The LED driver 14 is coupled to the battery via lines 36*a*-36*b*, and the LED chip 12 can be actuated by means of a switch 38 provided on the line 36*a*.

Further, since the cell 22 requires alternating current and the battery 34 provides direct current, a DC-AC converter 40 is provided. In FIG. 7, the DC-AC converter 40 is provided in the lamp module 10. The DC-AC converter 40 is coupled on one hand to the cell 22, and on the other hand to the battery 34 via lines 42*a*-42*b*. A second switch 44 is provided on the line 42*a* for allowing the cell 22 to be turned on/off. Since line 42*b* is a branch off line 36*b*, this setup requires three contacts (lines 36*a*-36*b* and 40*a*) from the lamp module 10.

Thus, during operation, the LED chip 12 can be turned on/off by means of switch 38, and the beam shaping functionality can be turned on/off by means of switch 44. In other words, a user can alter the beam shape simply by activating the switch 44, which switch can be a regular push button, a slider, or the like, provided on the lighting device.

FIG. 8 illustrates a variant of the lighting device of FIG. 7, wherein the DC-AC converter 40 instead of being provided in the lamp module 10 is mounted outside the lamp module, in the non-lamp module portion of the lighting device 30. This setup requires four contacts from the lamp module 10, but works otherwise similar as the lighting device in FIG. 7.

FIG. 9 illustrates another variant of the lighting device of FIG. 7, wherein the lamp module 10 further comprises a processor 46. The processor 46 is coupled on one hand to the DC-AC converter 40 and the LED driver 14 of the lamp module 10, and on the other hand to the battery 34 of the lighting device 30 via lines 48*a*-48*b*. A single switch 50 is provided on line 48*a* between the battery 34 and the processor 46. By means of the switch 50, a user can generate a signal having a certain characteristic, for example a signal having a certain duration-, sequence-, and/or number of pulses. The processor 46 in turn comprises predetermined instructions for translating certain signal characteristics into certain operations of the cell 22 and/or the LED chip 12. For example, during operation, a received single short pulse can cause the processor 46 to activate the LED chip 12 only (thus generating a collected beam of rays), while a single longer pulse or two short pulses can instruct the processor to activate both the LED chip 12 and the cell 22 (thus generating a wider beam of rays).

Thus, in this variant of the lighting device 30, the lamp module 10 requires only two contacts (lines 48*a*-48*b*), and it can easily be retrofitted to an existing traditional lighting device, such as a regular two-contact flash light. Further, both the light (on/off) and the beam shape (narrower-wider) can be controlled by the single switch 50 on the lighting device 30, which facilitates operation of the device.

Alternatively, the lamp module 10 can comprising electronics (not shown) positioned similar as the processor 46, the electronics being adapted to convert a variable input voltage (originating from the battery 34) into a constant direct current supplying the LED chip 12. On the other hand, the variable input voltage is supplied to the DC-AC converter 40, whereby a variable alternating current which varies in accordance with the input voltage supplies the cell 22. Thereby, when the input voltage is changed, the intensity of the LED chip 12 remains constant, but the shape of the beam is altered since the different voltage switches the cell. This solution also requires only two contacts, and therefore allows retrofit applications, for example in a flashlight where the voltage supplied to the lamp module is adjustable (for instance by means of a single turn knob on the lighting device).

The person skilled in the art realizes that the present invention by no means is limited to the preferred embodiments described above. On the contrary, many modifications and variations are possible within the scope of the appended claims. For example, any of the lighting devices disclosed in FIGS. 7-9 can be provided with a reflector as shown in FIGS. 6*a*-6*b*, and the lighting device in FIGS. 6*a*-6*b* can be of any type described in relation to FIGS. 7-9.

Also, even though a lamp module having only one LED chip 12 is described above, it should be understood that the lamp module can comprise several LED chips, for example LED chips emitting light of different colors. The LED chip(s) can also be coated with phosphor for converting light emitted from the LED chip to for instance white (i.e. a so-called phosphor converted LED).

Also, instead of the reflector 32 in FIGS. 6*a*-6*b*, other beam shaping elements can be used, such as TIR-optics or refractive or reflecting elements or a combination thereof.

The invention claimed is:

1. A lamp module, comprising:

at least one light emitting diode (LED) chip for emitting light, means for extracting and shaping light emitted from the chip(s), wherein at least one electrically switchable cell is adapted to receive light emitted from the chip(s), which cell(s) in a first state transmits incoming light without substantially altering a path of the light and in a second state alters the path of the light when the light passes the cell(s)

means for converting a variable input voltage into a constant direct current supplying the LED chip(s) and into a variable alternating current supplying the cell(s), wherein the alternating current supplying the cell(s) varies in accordance with the input voltage, and a base for allowing the lamp module to be fitted and connected to a lighting device.

2. A lamp module according to claim 1, wherein the at least one of the cell(s) is integrated into the means for extracting and shaping light emitted from the chip(s).

3. A lamp module according to claim 1, wherein the path of incoming light is altered by at least one of the cell(s) by means of one of scattering, refraction, reflection, and diffraction.

4. A lamp module according to claim 1, further comprising a LED driver coupled to said LED chip(s).

5. A lamp module according to claim 1, further comprising a DC-AC converter for converting direct current from an external power source, such as a battery, to alternating current for supplying said cell(s).

6. A lamp module according to claim 1, further comprising a processor configured to separately control said LED chip(s) and choose between the first and the second state of at least one of the cell(s) based on a input signal.

7. A lighting device, comprising a lamp module, comprising:

at least one light emitting diode (LED) chip for emitting light, means for extracting and shaping light emitted from the chip(s), wherein at least one electrically switchable cell adapted to receive light emitted from the chip(s), which cell(s) in a first state transmits incoming light without substantially altering a path of the light and in a second state alters the path of the light when the light passes the cell(s), wherein the lamp module comprises a processor, and wherein the lighting device further comprises a single switch for providing an input signal to said processor, means for converting a variable input voltage into a constant direct current supplying the LED chip(s) and into a variable alternating current supplying the cell(s), wherein the alternating current supplying the cell(s) varies in accordance with the input voltage, and a base for allowing the lamp module to be fitted and connected to a lighting device.

8. A lighting device, comprising a lamp module according to claim 1.

9. A lighting device according to claim 8, further comprising a DC-AC converter for converting direct current from an internal power source, such as a battery, to alternating current for supplying at least one of the cell(s).

10. A lighting device according to claim 8, further comprising a first switch for controlling choose between the first and the second state of at least one of the cell(s), and a second switch for controlling said LED chip(s).

11. A lighting device according to claim 8, further comprising a beam shaper, such as a reflector, and wherein said lamp module is positioned in said beam shaper.

12. A lighting device according to claim 8, wherein said lighting device is a non-mains connected device.

13. A lighting device according to claim 8, wherein said lighting device is a hand held device.

14. A lamp module according to claim 1, wherein the at least one of the cell(s) is integrated into the means for extracting and shaping light emitted from the chip(s).

15. A lamp module according to claim 1, wherein the path of incoming light is altered by at least one of the cell(s) by means of one of scattering, refraction, reflection, and diffraction.

16. A lamp module according to claim 1, further comprising a LED driver coupled to said LED chip(s).

17. A lamp module according to claim 1, further comprising a DC-AC converter for converting direct current from an external power source, such as a battery, to alternating current for supplying at least one of the cell(s).

18. A lamp module according to claim 1, further comprising a processor configured to separately control said LED chip(s) and choose between the first state and the second state of at least one of the cell(s).based on a input signal.

19. A lighting device, comprising a lamp module according to claim 1.

20. A lamp module, comprising:

at least one light emitting diode (LED) chip for emitting light, means for extracting and shaping light emitted from the chip(s), and a base for allowing the lamp module to be fitted and connected to a lighting device, wherein at least one electrically switchable cell(s) is adapted to receive light emitted from the chip(s), which cell(s) in a first state transmits incoming light without substantially altering a path of the light and in a second state alters the path of the light when the light passes the cell(s)

wherein the lamp module comprises plural cells with different properties.

* * * * *